United States Patent [19]

Nakayama

[11] Patent Number: 4,716,529

[45] Date of Patent: Dec. 29, 1987

[54] ELECTRONIC GAME APPARATUS

[75] Inventor: Jin Nakayama, Tokyo, Japan

[73] Assignee: Casio Computer Co., Ltd., Tokyo, Japan

[21] Appl. No.: 930,955

[22] Filed: Nov. 12, 1986

Related U.S. Application Data

[63] Continuation of Ser. No. 632,531, Jul. 19, 1984, abandoned.

[30] Foreign Application Priority Data

Jul. 29, 1983 [JP] Japan ..... 58-137475

[51] Int. Cl.[4] ..... A63F 3/02

[52] U.S. Cl. ..... 364/410; 364/412; 273/DIG. 28; 273/237

[58] Field of Search ..... 364/410, 412; 273/313, 273/148 R, 138 R, 1 E, 85 G, DIG. 28, 237, 242, 260, 273

[56] References Cited

U.S. PATENT DOCUMENTS

| | | | |
|---|---|---|---|
| 3,923,306 | 12/1975 | Hidalgo et al. | 434/128 |
| 4,019,745 | 4/1977 | Mustelier | 273/136 A |
| 4,156,976 | 6/1979 | Mikun | 434/128 |
| 4,169,262 | 9/1979 | Schwarts et al. | 273/DIG. 28 |
| 4,270,755 | 6/1981 | Willhide et al. | 273/313 |
| 4,322,074 | 3/1982 | James et al. | 273/1 E |
| 4,327,915 | 5/1982 | Bromley | 273/85 G |
| 4,339,135 | 7/1982 | Breslow et al. | 273/237 |
| 4,355,806 | 10/1982 | Buck et al. | 273/1 E |
| 4,492,581 | 1/1985 | Arai et al. | 434/128 |
| 4,634,129 | 1/1987 | Martinez | 273/287 |

OTHER PUBLICATIONS

Jerry and Eric Eimbinder, "Electronic Game", Oct. 1980, *Popular Electronics*, pp. 53–59.

"Machine Design", vol. 50, No. 12, May 1978, pp. 4, 6.

*Primary Examiner*—Jerry Smith

*Assistant Examiner*—Kimthanh Tbui

*Attorney, Agent, or Firm*—Frishauf, Holtz, Goodman & Woodward

[57] ABSTRACT

An electronic game apparatus has a handicap data memory for storing a plurality of types of handicap data corresponding to piece positions and the number of extra pieces displayed on a display unit, and a game level designation data memory for specifying a game level in accordance with the skill of the challenger. The game level is determined by a move guessing number, representing the number of further challenger moves that the computer can guess, and by the handicap data. When a game level is selected, the corresponding handicap data is read out from the handicap data memory to display the handicap data on a display unit under the control of a control section.

10 Claims, 18 Drawing Figures

FIG. 6

| LEVEL VALUE | MOVE GUESSING RANK | NUMBERS OF EXTRA PIECES |
|---|---|---|
| 1 | A | 0 |
| 2 | B | 0 |
| 3 | C | 0 |
| 4 | C | 4 |
| 5 | C | 8 |

ELECTRONIC GAME APPARATUS

This application is a continuation of application Ser. No. 632,531, filed July 19, 1984, now abandoned.

BACKGROUND OF THE INVENTION

The present invention relates to an electronic game apparatus for allowing a player to play a game with a computer wherein the player and computer alternately make moves after piece positions of the player and the computer are preset by a key input operation.

In conventional electronic game apparatuses such as those used to play Othello, go and shogi, a plurality of game levels showing the matching power of the computer against the player are preset in a computer. When a player plays the game with the computer, the challenger is handicapped from the beginning of the game in accordance with the skill of the challenger. In practice, the challenger selects one of the modes in accordance with his skill and is amused by the game. Each successive game level represents an increase in the number of further moves by the challenger that the computer can guess in advance, and so an increased likelihood of the computer making an ideal move. However, when the skill of the challenger improves and he selects a higher game level, the "thinking" time (i.e., calculation time) of the computer is prolonged, resulting in a loss of amusement.

SUMMARY OF THE INVENTION

The present invention has been made to solve the above problem, and has as its object to provide an electronic game apparatus capable of setting game levels in accordance with the number of extra pieces or odds given to the computer in a game start pattern, which allows the challenger to select a higher game level without increasing the calculation time of the computer.

In order to achieve the above object of the present invention, there is provided an electronic game apparatus comprising: handicap data designating means for designating piece positions and the number of extra pieces for a computer at a game start pattern displayed on a display unit; row/column designation input means for designating a piece position of a move by a challenger on said display unit; handicap data storage means for storing a plurality of types of handicap data; game level designating means for designating a game level of the computer in accordance with the skill of the challenger; game level designation data storage means for storing a plurality of game level designation data; controlling means, connected to said handicap data designation means, said row/column designation input means, said handicap data storage means, said game level designation means and said game level designation data storage means, for accessing said handicap data storage means in accordance with a level designated by said game level designation means; and display means for displaying the game level selected by said controlling means and the handicap data.

According to the electronic game apparatus having the configuration described above, a plurality of game levels can be set in accordance with the number of possible moves, which depends on the number of further challenger moves guessed by the computer, and which in turn influences the likelihood of the computer making the best possible move in response to a move by the challenger. The game also has handicap data representing the piece positions and the number of extra computer pieces displayed on the display unit. The challenger can select any game level in accordance with his skill and thus can be amused by the game. In this case, even if the challenger selects a high game level, the number of pieces of the computer, i.e., the handicap of the challenger, can be simply increased. Therefore, the guessing time (i.e., calculation time) of the computer will not be prolonged, thereby providing a fast-moving and enjoyable game.

BRIEF DESCRIPTION OF THE DRAWINGS

FIG. 6 is a table showing the contents of the respective game levels;

FIGS. 7(2) to 7(4) show start game states of the different game levels in the Othello game, respectively;

FIGS. 8(2) to 8(4) are respectively plan views of the display unit which show handicapped modes of the challenger in the chess game shown in FIG. 8(1).

DETAILED DESCRIPTION OF THE PREFERRED EMBODIMENTS

Figure 1:
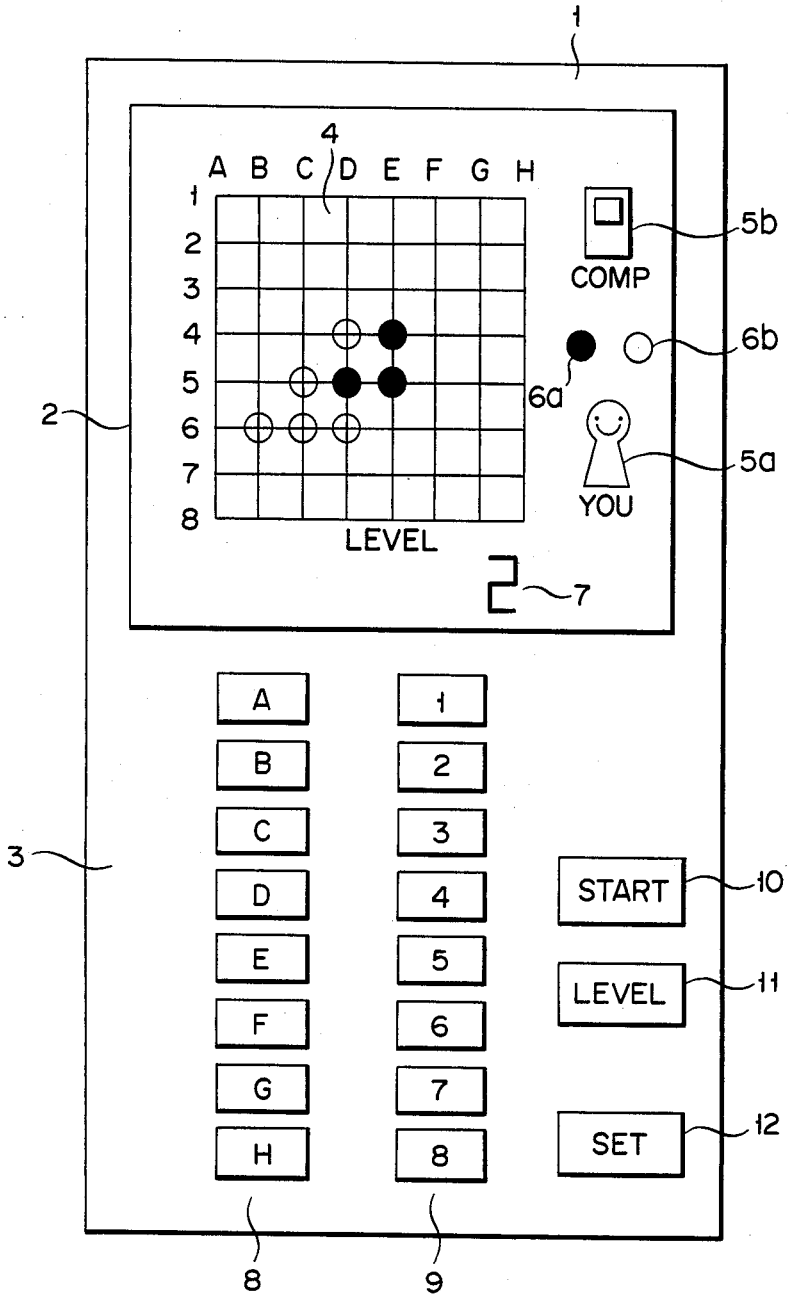
FIG. 1 is a plan view of an electronic game apparatus according to an embodiment of the present invention.

The present invention will be described in detail with reference to an embodiment taken in conjunction with the accompanying drawings. The following embodiment is exemplified when the electronic game apparatus is applied to a modified gobang game played on a go board with the challenger and the computer making alternate moves and attempting to be first to place eight of their counters in a line. In this game, when black pieces sandwich a white piece, this white piece is turned over and so becomes a black piece, and vice versa. The outer appearance of the electronic game apparatus will be described with reference to FIG. 1. Referring to FIG. 1, reference numeral 1 denotes a case. A display unit 2 and a keyboard 3 are arranged on the upper surface of the case 1. A go board 4 having row and column lines constituting a matrix is displayed in the display unit 2. A black or white piece is displayed at an intersection in accordance with the key input operation. Letters A to H are displayed above the board 4 to indicate column positions. Similarly, numerals 1 to 8 are displayed to indicate row positions. A challenger display electrode 5*a* for indicating the challenger's turn, a computer display electrode 5*b* for indicating a computer's turn, a black turn display electrode 6*a*, white turn display electrode 6*b* and a level display 7 are arranged in the display unit 2. The level display 7 displays the word "LEVEL" together with a numeral indicating a level number. The keyboard 3 has eight column keys 8 for specifying the respective column positions and eight row keys 9 for specifying the respective row positions. Letters A to H are respectively printed on the upper surfaces of the keys 8, and numerals 1 to 8 are respectively printed on the upper surfaces of the keys 9. The keyboard 3 also has a start key 10, a level key 11 and a set key 12.

Figure 2:
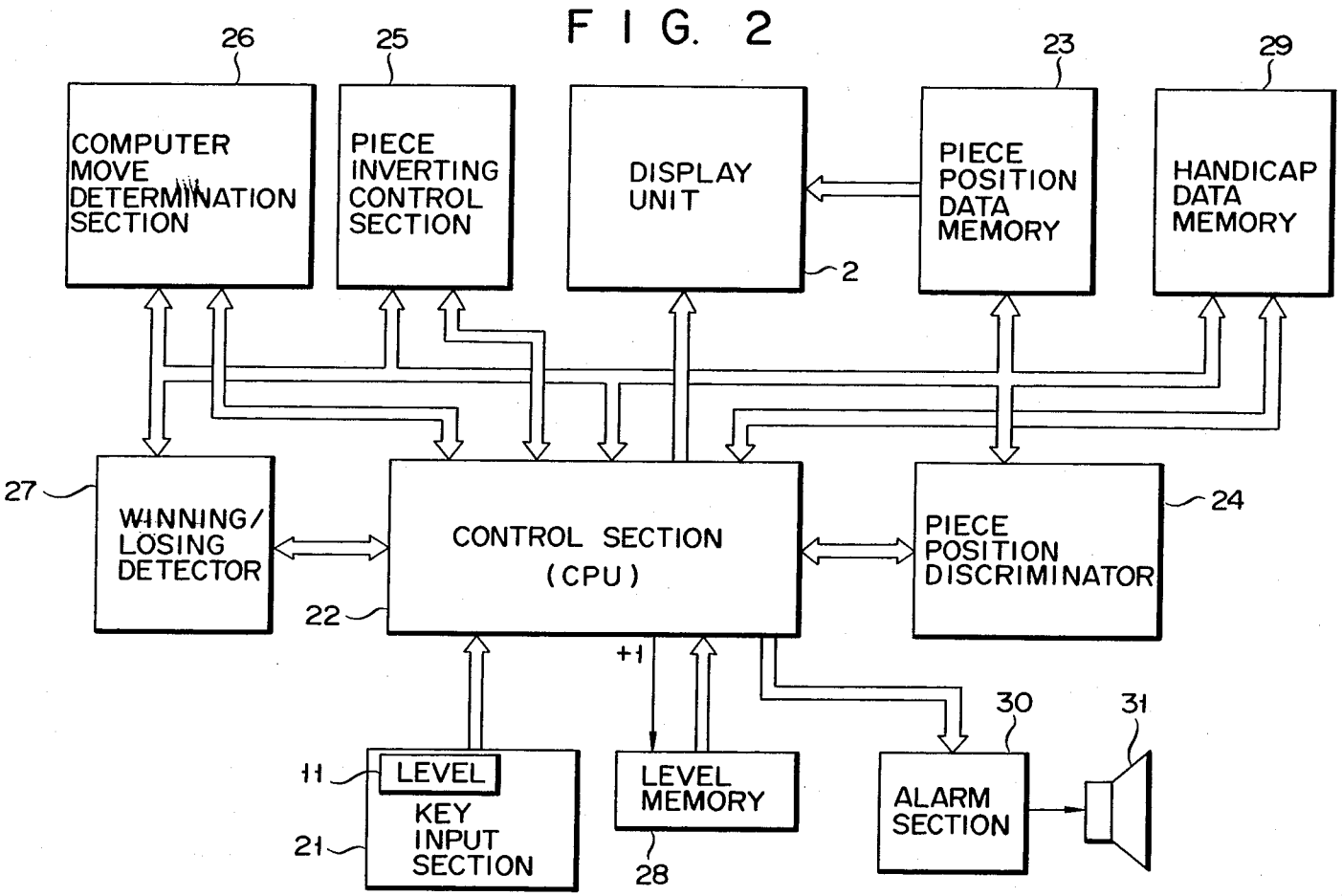
FIG. 2 is a block diagram of a circuit of the electronic game apparatus shown in FIG. 1.

The electronic circuit arranged in the case 1 will be described with reference to FIG. 2. Reference numeral 21 denotes a key input section constituted by the keyboard 3. A key input is supplied to a control section 22. The control section 22 is connected to the display unit 2, a piece position data memory 23 for storing data of piece positions on the board 4, a piece position discriminator 24 for discriminating whether or not a piece can be placed in a piece position designated by the key input, a piece inverting control section 25 for turning over a piece sandwiched by the opponent's pieces, a computer move determination section 26 for selecting the next move of the computer in response to the immediately preceding move by the challenger, a winning-/losing detector 27 for detecting winning/losing every time the piece is placed, a level memory 28 for storing level data which can be accessed by the level key 11, a handicap data memory 29 for storing handicap data, and an alarm section 30 for driving a buzzer 31 in accordance with the progress of the game.

Figure 3:
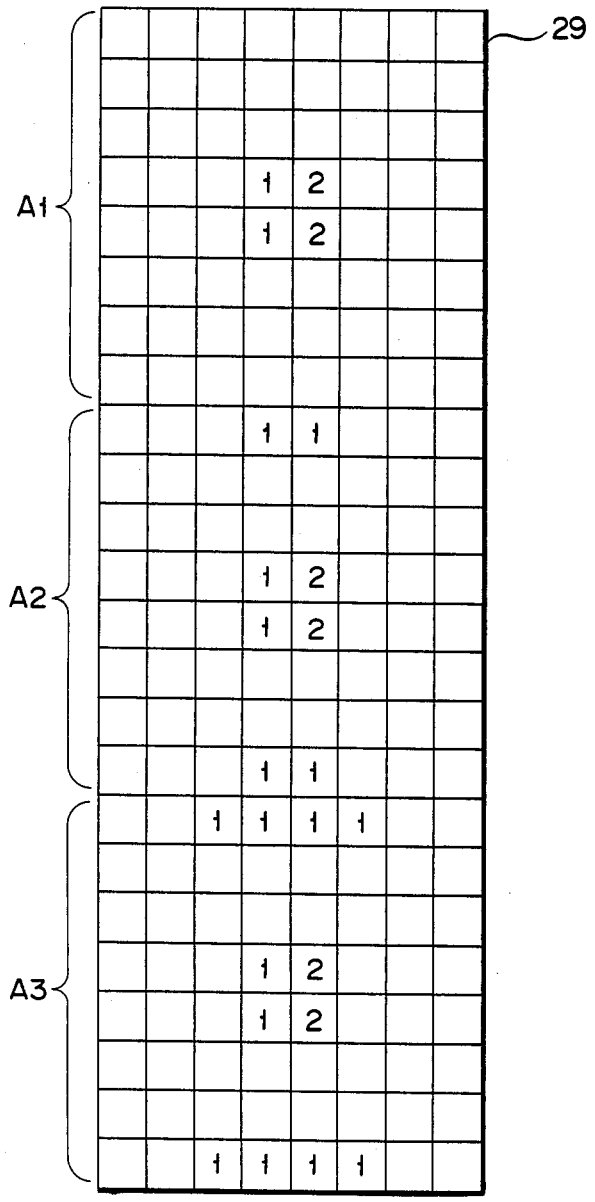
FIG. 3 is a data table of handicap data in a handicap data storage section 29 shown in FIG. 2.

The handicap data memory 29 has memory areas A1, A2, A3 . . . , as shown in FIG. 3. When a white piece of the computer is placed in a given position on the display, a corresponding binary code is stored in a memory location which is indicated by numeral 1 and which corresponds to the given position. When a black piece of the challenger is placed in any position on the display, a corresponding binary code is stored in a memory location which is indicated by numeral 2 and which corresponds to the specified position. The contents of the memory area A1 correspond to the state shown in FIG. 4(1). The contents of the memory area A2 correspond to the state shown in FIG. 4(4). The contents of the memory area A3 correspond to the state shown in FIG. 4(5).

Figure 4:
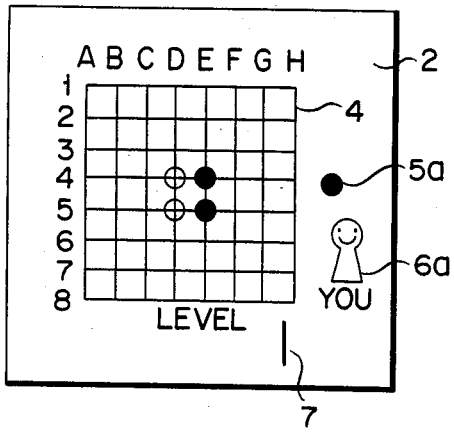
FIGS. 4(1) to 4(5) show game start states of the different game levels which are displayed on a display unit, respectively.
Figure 4:
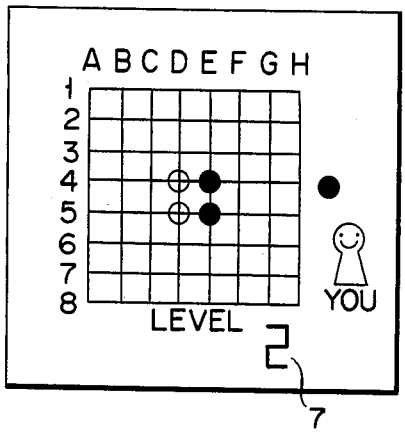
Figure 4:
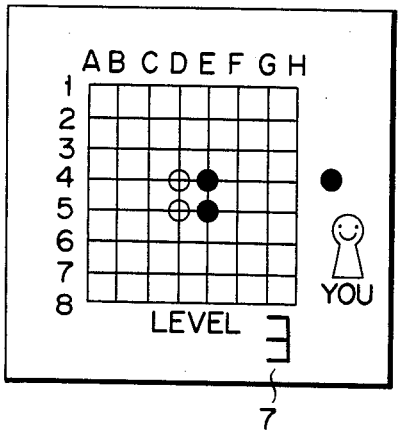
Figure 4:
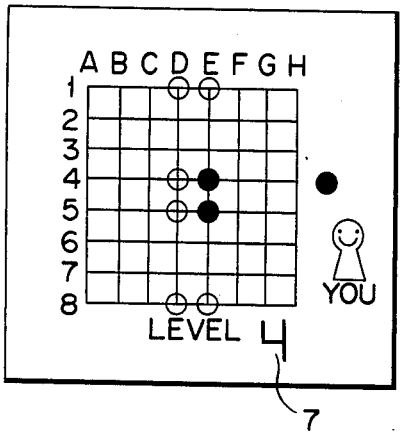
Figure 4:
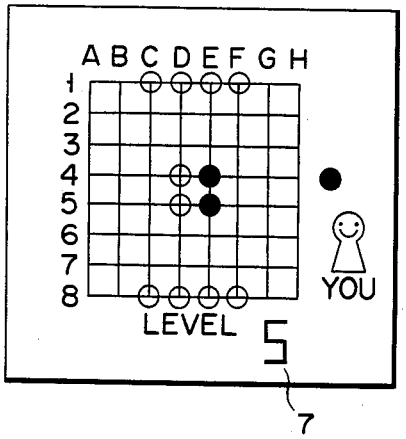
Figure 5:
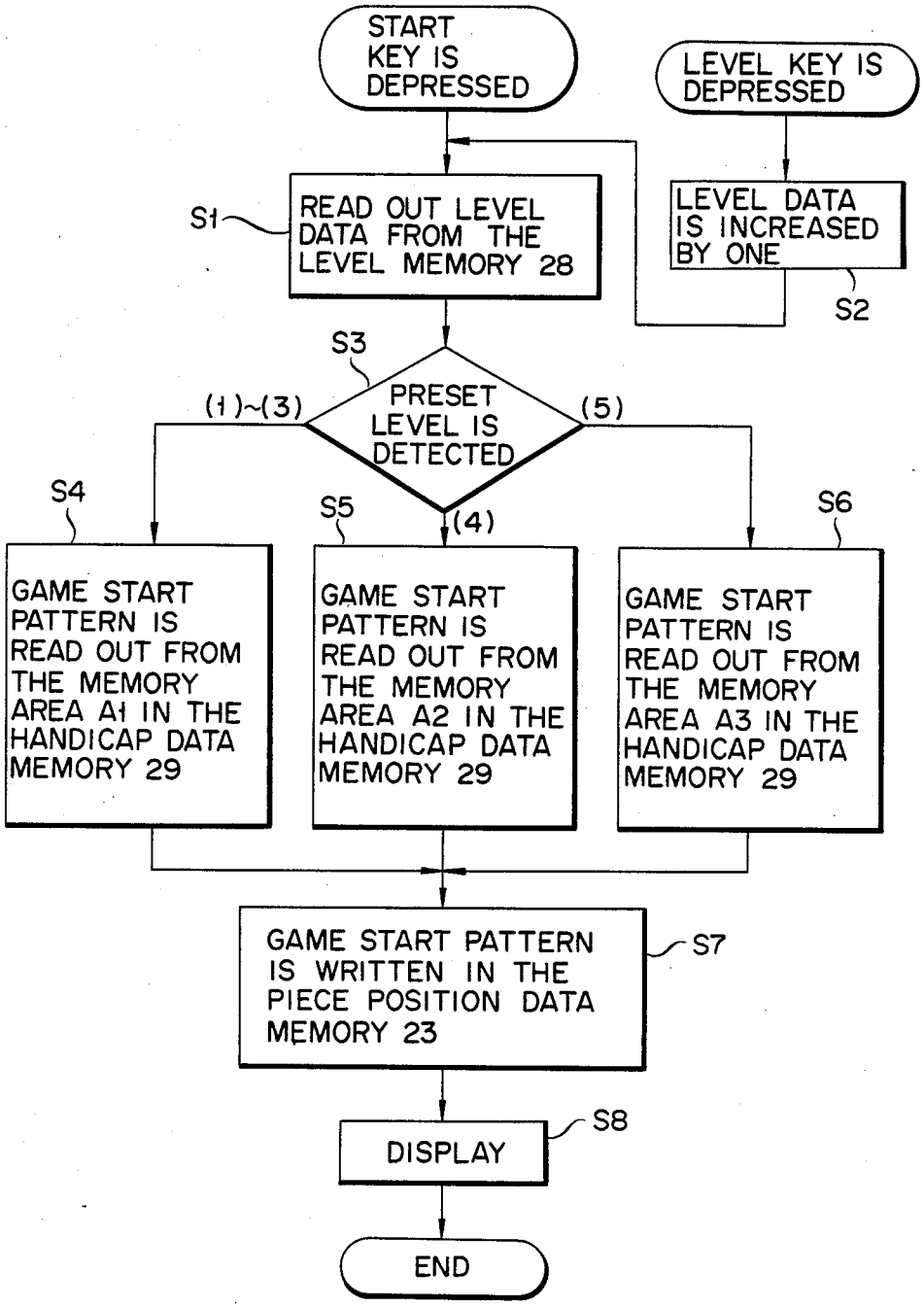
FIG. 5 is a flow chart for explaining the operation of the electronic game apparatus shown in FIG. 1.

The operation of the electronic game apparatus will be described with reference to FIG. 3, FIGS. 4(1) to 4(5), and the flow chart of FIG. 5. When the challenger or user wishes to play a modified gobang game, he depresses the start key 10. The control section 22 is then started to read out the storage contents of the level memory 28, as shown in step 1 in FIG. 5. For example, the numeral "1" is displayed on the level display 7, as shown in FIG. 4(1). The control section 22 causes the contents of the piece position data memory 23 to be set in a game start state. Two black pieces and two white pieces are displayed on the display unit 2, as shown in FIG. 4(1). The control section 22 also drives the challenger display electrode 5*a* and the black turn display electrode 6*a*. In this state, if the challenger wishes to select a higher game level in accordance with his skill, the level key 11 is operated to set desired level data in the level memory 28 by incrementing the level data by one, as shown in step 2. Levels 1 to 5, for example, can be set in the level memory 28, as shown in FIG. 6. Levels 1 to 3 have different move guessing ranks A, B and C, which indicate different values for how many further challenger moves the computer can guess. Although the move guessing range is kept constant (i.e., move guessing range C) in levels 4 and 5, in these levels the computer has respectively 4 and 8 extra pieces on the board at the start of play. Every time the level key 11 is operated, the content of the level memory 28 is updated. The preset level in the level memory 28 is detected in step S3. The content of the level memory 28 is displayed as one of the states shown in FIGS. 4(1) to 4(5). When the detected level corresponds to one of levels 1 to 3, the game start pattern is read out from the memory area A1 (FIG. 3) in the handicap data memory 29 in step S4 and is written in the piece position data memory 23 in step S7. However, when the detected level corresponds to level 4, the game start pattern is read out from the memory area A2 in step S5 and is written in the piece position data memory 23 in step S7. Similarly, when the detected level corresponds to level 5, the game start pattern is read out from the memory area A3 and is written in the piece position data memory 23 in step S7. In the levels 1 to 3, a corresponding move guess number represented by A, B or C is set by the move determination section 26. The computer can guess one move in level 1, two moves in level 2 and three moves in level 3. In level 4, the computer guesses three moves and has four extra pieces which are represented by the handicap data from the handicap data memory 29. The handicap data is then, in step S7, stored in the piece position data memory 23. In step S8, four white pieces are displayed at positions D1, E1, D8 and E8 in accordance with the handicap data, as shown in FIG. 4(4).

In level 5, handicap data representing eight extra pieces is read out from the handicap data memory 29 and is stored in the piece position data memory 23. Eight white pieces are displayed at positions C1, D1, E1, F1, C8, D8, E8 and F8, as shown in FIG. 4(5).

When the challenger selects a desired level as described above, he uses the column and row keys 8 and 9 to specify a position of a black piece so as to sandwich a white piece. After the challenger has confirmed the position of the black piece, he depresses the set key 12. When the position of the black piece is specified by the column and row keys 8 and 9, the piece position discriminator 24 is started to check whether or not the piece can be placed in the specified position. If the piece cannot be placed in the specified position, the control section 22 causes the alarm section 30 to drive the buzzer 31, thereby producing an error sound. However, when the piece can be placed in the specified position, the control section 22 supplies an enable signal to the piece inverting control section 25 upon operation of the set key 12, so that the sandwiched white piece is turned into a black piece. Thereafter, the computer move determination section 26 is operated to determine the next white move in response to the immediately preceding move of the black piece. It will be understood that computer move determination section 26 has a set program used for "guessing" and can learn the contents in piece position data memory 23 to determine the next white move in favor of the computer. In the manner described above, the game progresses. The winning-/losing detector 27 discriminates whether eight counters are placed in a line every time a piece is moved. When winning/losing cannot be determined, the game continues. Whenever eight counters are placed in a line, the game is ended.

Figure 7:
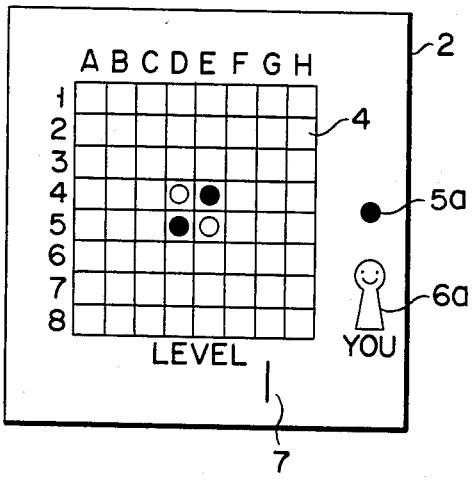
FIG. 7(1) is a plan view of the display unit when the electronic game apparatus of FIG. 1 is applied to an Othello game.
Figure 7:
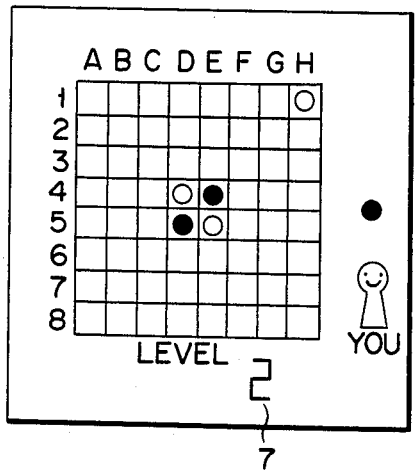
Figure 7:
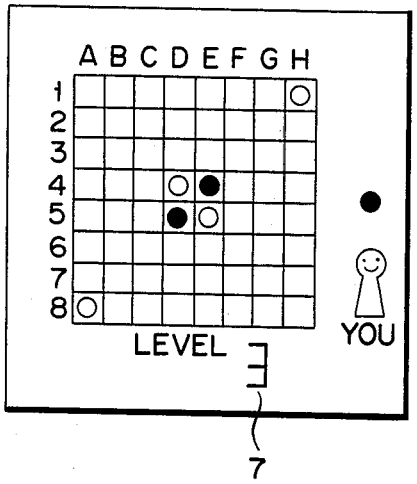
Figure 7:
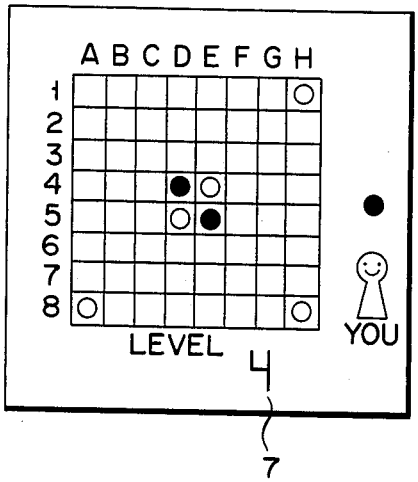

FIGS. 7(1) to 7(4) show another embodiment when the present invention is applied to the Othello game. In this embodiment, the move guess number of the computer is fixed, and different game levels are set in accordance with only handicap data. No handicap data is used in level 1. In level 2, handicap data representing one white piece at the upper right corner is used at the beginning of the game, as shown in FIG. 7(2). Similarly, in level 3, handicap data representing two white pieces at the upper right corner and the lower left corner is used, as shown in FIG. 7(3). In level 4, handicap data representing three white pieces at the corners excluding the upper left corner is used, as shown in FIG. 7(4). In this manner, the higher the game level becomes, the more difficult the game becomes.

In the above embodiment, the level and handicap data are selected by the level key 11. However, a handicap data selection key may be arranged to select handicap data. In the above embodiment, the handicap data is given to the computer. However, the handicap data may be given to the challenger.

The present invention is not limited to the gobang-like game or to the Othello game but can be extended to any other game. For example, if the present invention is applied to shogi, the handicap would indicate the omission of pieces such as the spear, rook, bishop and knight.

Figure 8:
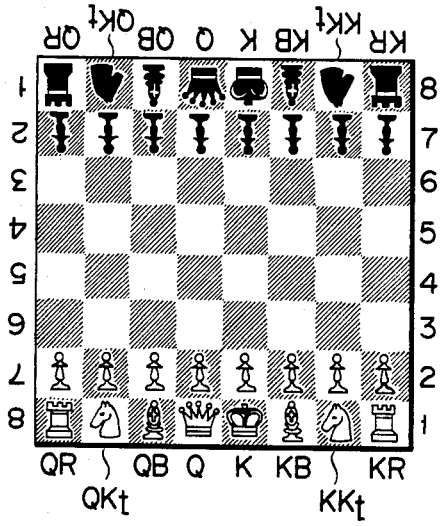
FIG. 8(1) is a plan view of the display unit when the electronic game apparatus of FIG. 1 is applied to a chess game.
Figure 8:
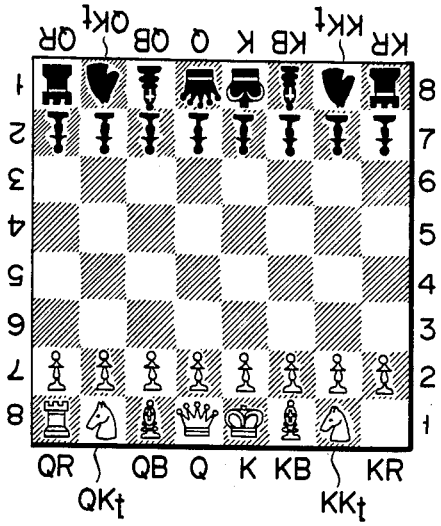
Figure 8:
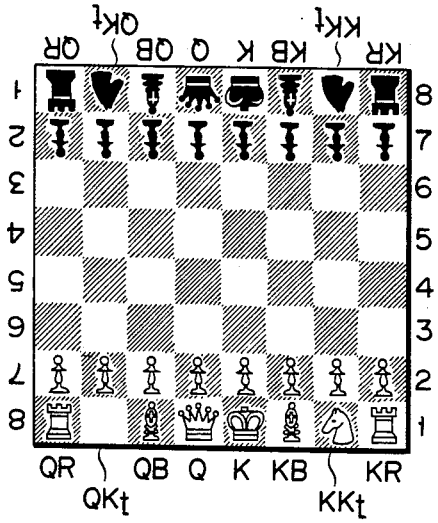
Figure 8:
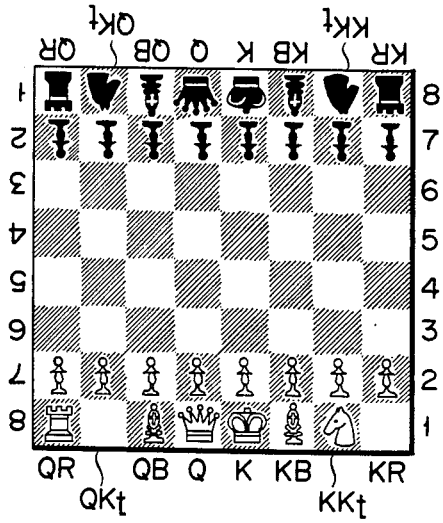

FIG. 8(1) shows a chess to which the present invention is applied. Referring to FIG. 8(1), a game of chess is played between the computer and the challenger without a handicap. FIG. 8(2) shows a case wherein the king's rook of the challenger is omitted. FIG. 8(3) shows a case wherein the queen's knight of the challenger is omitted. FIG. 8(4) shows a case wherein the queen's knight and king's rook are omitted.

What is claimed is:

1. An electronic game apparatus, comprising:

display means for displaying a game board, a plurality of pieces identified with a challenger player, and a plurality of pieces identified with a computer player, said game board having piece positions in the form of a matrix comprised of a plurality of rows and a plurality of columns;

piece position data memory means for storing piece identification data which includes identities and positions of the pieces identified with the challenger and computer players as displayed on said display means;

handicap data storage means for storing handicap data including patterns of pieces identified with the challenger and computer players which patterns are unfavorable to the challenger player;

handicap data designation means for designating handicap data stored in said handicap data storage means;

controlling means for reading the handicap data designated by said handicap data designation means, and for writing the readout data in said piece position data memory means;

piece position input means for enabling the challenger player to designate a position of a row and column of a challenger player's piece which is to be displayed on the game board and stored in said piece position data memory means;

piece identification data altering means coupled to said piece position input means for altering, after the designated position of the challenger player's piece is stored in said piece position data memory means, piece identification data identified with the computer players stored in said piece position data memory means in accordance with relative positions between the pieces identified with the challenger and computer players stored in said piece position data memory means; and determination means coupled to said piece position input means, said piece position data memory means and said piece identification data altering means, for determining, by the use of a determination program, piece position data of the computer player's piece on the basis of piece position data of a challenger player's piece newly input through said piece position input means, and the piece identification data of said piece position data memory means that has been altered by said piece identification data altering means, storing the thus-determined data in said piece position data memory means, and for subsequently causing said piece identification data altering means to operate.

2. An apparatus according to claim 1, further comprising judging means responsive to a challenger player designating a piece position via said piece position input means for judging whether or not a designated piece position is valid.

3. An apparatus according to claim 1, further comprising detecting means for detecting winning or losing of the challenger player in accordance with contents of said piece position data memory means which have been altered by said piece identification data altering means.

4. An apparatus according to claim 3, wherein said detecting means includes means for detecting that a predetermined number of pieces associated with the challenger or computer player, stored in said piece position data memory means, are aligned in a common direction with respect to said display means, to determine winning or losing.

5. An apparatus according to claim 1, wherein said display means includes means for displaying a game board having a plurality of lines extending along the columns and a plurality of lines extending along the rows, for forming a matrix, and said display means further includes means for displaying white pieces and black pieces on intersections of the lines serving as the piece positions.

6. An apparatus according to claim 1, wherein said piece position data memory means includes a plurality of areas corresponding to the piece positions of the game board displayed on said display means, for storing data distinctively representing the pieces identified with the challenger player, those identified with the computer player, and vacant positions.

7. An apparatus according to claim 1, wherein said piece position input means includes a plurality of keys for designating piece positions along the columns, and a plurality of keys for designating piece positions along the rows.

8. An apparatus according to claim 1, wherein said handicap data storage means includes a plurality of areas corresponding to the piece positions of the game board, for storing patterns of predetermined combination of the pieces identified with the challenger player and those identified with the computer player which are greater in number than the challenger player's pieces.

9. An apparatus according to claim 1, wherein said handicap data designation means includes a level key for designating sequentially different handicap data, in accordance with a number of operations of the level key.

10. An apparatus according to claim 1, wherein said piece identification data altering means includes means for altering contents of said piece position data memory means, when each piece is set in said piece position data memory means and a piece identified with one of the players is sandwiched by pieces identified with the other of the players, so that the sandwiched piece is altered to a piece identified with the other of said players.

* * * * *